US008718864B2

(12) United States Patent
Dittmers et al.

(10) Patent No.: US 8,718,864 B2
(45) Date of Patent: May 6, 2014

(54) SYSTEM FOR COLLECTING OPERATING DATA OF A VEHICLE

(75) Inventors: Reinhard Dittmers, Königsfeld-Erdmannsweiler (DE); Dirk Gandras, Gottmadingen (DE); Michael Gut, Bräunlingen (DE); Reinhold Schlenker, Niedershach (DE); Frank Schulz, Niedereschach-Kappel (DE)

(73) Assignee: Continental Automotive GmbH, Hannover (DE)

( * ) Notice: Subject to any disclaimer, the term of this patent is extended or adjusted under 35 U.S.C. 154(b) by 162 days.

(21) Appl. No.: 13/141,054

(22) PCT Filed: Dec. 16, 2009

(86) PCT No.: PCT/EP2009/067276

§ 371 (c)(1), (2), (4) Date: Jun. 20, 2011

(87) PCT Pub. No.: WO2010/069991

PCT Pub. Date: Jun. 24, 2010

(65) Prior Publication Data

US 2011/0257815 A1 Oct. 20, 2011

(30) Foreign Application Priority Data

Dec. 18, 2008 (DE) ..... 10 2008 062 717

(51) Int. Cl.
*G07C 5/02* (2006.01)

(52) U.S. Cl.
USPC ..... 701/33.2; 701/2; 701/33.3; 701/33.4; 701/430; 340/426.13; 340/426.16; 340/426.35; 340/426.36

(58) Field of Classification Search
USPC ..... 701/2, 33.3, 33.4, 430, 33.2; 340/426.13, 426.16, 426.35, 426.36
See application file for complete search history.

(56) References Cited

U.S. PATENT DOCUMENTS

| | | | | |
|---|---|---|---|---|
| 4,188,618 | A * | 2/1980 | Weisbart | 340/870.16 |
| 7,243,007 | B2 * | 7/2007 | Wilson et al. | 701/2 |
| 8,200,984 | B2 * | 6/2012 | Esfandabadi | 713/189 |
| 8,275,509 | B2 * | 9/2012 | Fritsch et al. | 701/30.6 |
| 2005/0107930 | A1 * | 5/2005 | Park | 701/35 |
| 2006/0061458 | A1 * | 3/2006 | Simon et al. | 340/426.35 |
| 2007/0096938 | A1 * | 5/2007 | Lopez et al. | 340/825.69 |
| 2008/0059701 | A1 * | 3/2008 | Esfandabadi | 711/115 |
| 2008/0151867 | A1 | 6/2008 | Goodwin et al. | |
| 2008/0244735 | A1 | 10/2008 | Callenryd et al. | |
| 2010/0191413 | A1 * | 7/2010 | Fritsch et al. | 701/34 |
| 2010/0250053 | A1 * | 9/2010 | Grill et al. | 701/33 |
| 2010/0305808 | A1 * | 12/2010 | Littwin | 701/33 |
| 2011/0137490 | A1 * | 6/2011 | Bosch et al. | 701/2 |

FOREIGN PATENT DOCUMENTS

| | | | |
|---|---|---|---|
| DE | 10392256 | T5 | 5/2005 |
| DE | 10 2006 044 737 | | 3/2008 |
| DE | 10 2006 044 737 | A1 | 3/2008 |
| EP | 1 104 922 | A2 | 6/2001 |
| EP | 0 899 889 | B1 | 7/2005 |
| FR | 2 860 615 | | 4/2005 |
| FR | 2860615 | A1 | 4/2005 |
| WO | WO 99/09662 | A1 | 2/1999 |
| WO | WO 2007/058607 | | 5/2007 |
| WO | WO 2007058607 | A1 | 5/2007 |
| WO | WO 2009/021825 | | 2/2009 |
| WO | WO 2009/021825 | A1 | 2/2009 |

* cited by examiner

*Primary Examiner* — John R Olszewski
*Assistant Examiner* — Truc M Do
(74) *Attorney, Agent, or Firm* — Cozen O'Connor

(57) ABSTRACT

A system for collecting operating data of a vehicle, including a digital tachograph that can be installed rigidly in the vehicle, and a receiver module for receiving data for controlling the tachograph. The module is removalby connected to the tachograph by way of an interface prescribed by the tachograph. At least one remote control is equipped with a transmitter for operating the tachograph the remote control being adapted to wirelessly transfer data using the receiver module.

14 Claims, 1 Drawing Sheet

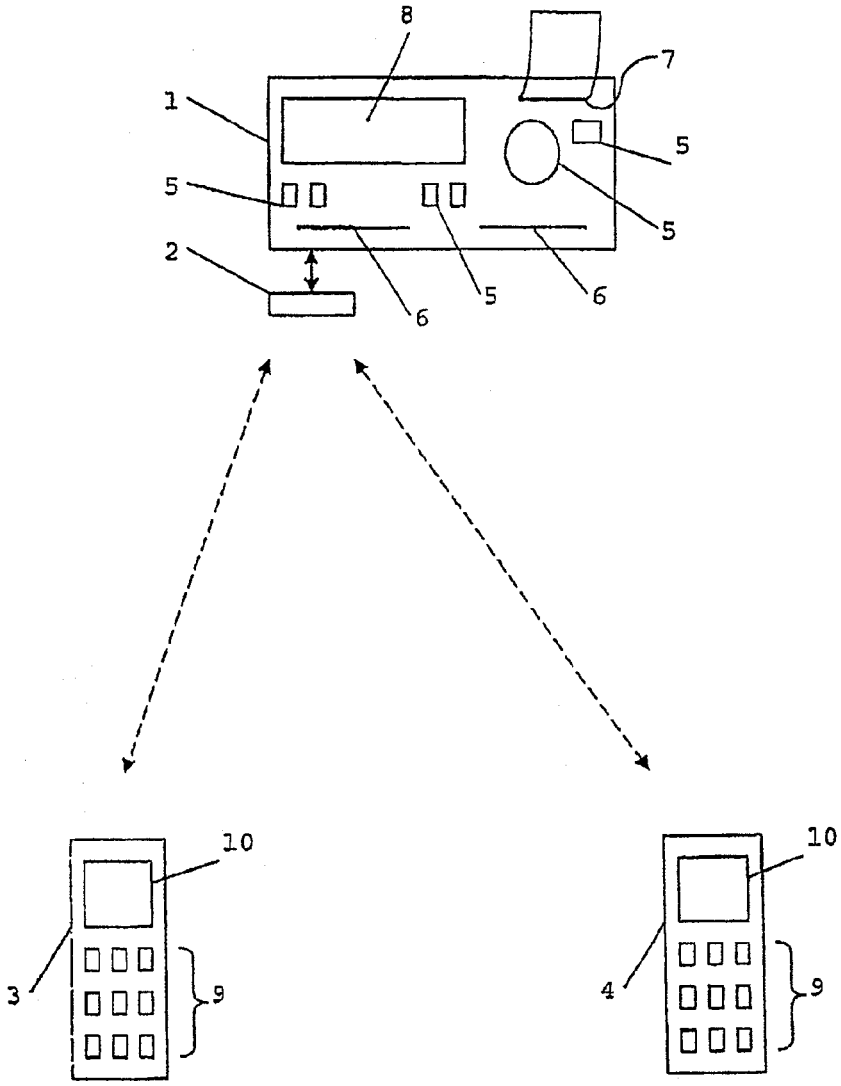
8
7
1
5
5
5
2
6
5
6
10
3
9
10
4
9

SYSTEM FOR COLLECTING OPERATING DATA OF A VEHICLE

CROSS REFERENCE TO RELATED APPLICATIONS

This is a U.S. national stage of application No. PCT/EP2009/067276; filed on 16 Dec. 2009. Priority is claimed on German Application No.: 10 2008 062 717.8, filed 18 Dec. 2008; the contents of which are incorporated here by reference.

BACKGROUND OF THE INVENTION

The invention relates to a system for capturing operating data for a vehicle that comprises a typically digital tachograph installed permanently in a vehicle, and to a vehicle equipped with such a system.

Field of the Invention

Vehicle information systems and digital tachographs have hitherto usually been controlled using keys and displays which are located directly on the tachograph. This requires barrier-free access to the operator control elements of corresponding appliances and the arrangement of appliances in the direct field of vision and operating environment of the driver.

It is currently possible to control the appliances independently of their installation location only if the appliances are linked to a permanently installed central display and to possible operator control keys, such as a steering wheel keypad, via a wired interface by the vehicle manufacturer when the vehicle design is actually stipulated.

User guidance for the appliances is committed to a sequence which is set at the time of delivery, at the time at which the tachograph is installed in the vehicle, or when the vehicle is delivered and commissioned. In the case of digital tachographs the user guidance is committed to one version by a complex authorization process.

One disadvantage is that the options for selecting the installation location for the appliances are restricted and operator control independent of the installation location of the appliances has been implementable hitherto only by a high level of integration in the cockpit and cabin vehicle system. The user guidance for the system using menu texts, symbols, acoustics, and the operator control of one or more keys or display menus is committed to the delivery condition of the vehicle and by the firmware version, which is frozen at the time of production of the system and is authorized for the digital tachograph on a case-by-case basis.

SUMMARY OF THE INVENTION

An object of the invention is developing an appropriate system that allows operator control of a tachograph independently of the installation location of said tachograph, the layout and arrangement of said operator control in a vehicle also being able to be stipulated subsequently with little complexity.

The proposed system for capturing operating data for a vehicle comprises a digital tachograph installed permanently in the vehicle, and also a receiver module for receiving data for controlling the tachograph, which receiver module is connected to said tachograph detachably via an interface prescribed by the tachograph, and also at least one remote control, equipped with a transmitter, for controlling the tachograph. The remote control is set up for wireless data transmission with the receiver module. This allows the tachograph to be controlled independently of the installation location of the tachograph in a manner that does not require any design of additional operator control elements which needs to be stipulated during the actual vehicle design. On the contrary, it is also possible to stipulate how and from where the tachograph can be controlled after the tachograph has been installed. The design of the operator control of the tachograph can also be easily changed and customized to suit user requirements subsequently.

The system may be designed such that the remote control can be used to query working hours and distances traveled and to request printouts with information that has been ascertained by the tachograph. It is thus possible to allow all the functions which can be retrieved using the operator control elements directly on the tachograph to be controlled preferably also using the operator control elements of the remote control. In addition, the remote control can be used to make inputs relating to activities outside of the vehicle in situ.

In one preferred embodiment, the remote control is equipped with a receiver and the receiver module is equipped with a transmitter for transmitting information ascertained by the tachograph. The at least one remote control may also have a display for displaying information. Information that can otherwise be presented only on a display of the tachograph itself can then also be displayed on a display of the remote control, possibly even in a different presentation. In addition, it may also be possible to present further information that the display of the tachograph itself is not designed to reproduce.

As a result of the remote control and/or the receiver module having been appropriately set up by programming, the system may be designed such that an input on the remote control used for the purpose of activating a particular function or setting for the tachograph is logically different than an input for the purpose of activating the same function or setting on the tachograph itself. For the purpose of activating particular settings and functions of the tachograph, which requires the operation of a plurality of keys using the operator control elements of the tachograph itself, it is possible to use the keys of the remote control to operate a significantly smaller number of keys, ideally even just one key since the remote control has a larger number of keys than the tachograph itself.

The system may comprise at least one first remote control and a second remote control for transmitting data to the receiver module, which differ from one another such that an input on the first remote control which is prescribed for the purpose of activating a particular function or setting for the tachograph differs from an input for the purpose of activating the same function or setting by the second remote control.

The remote controls may be different than one another both in terms of different configurations and in terms of design and may have keys in a different number or arrangement. This allows the remote control to be designed for specific users or sectors that can either take place by interchanging the user-specific remote control or else by selecting a user-specific mode.

The inputs may be different from one another by virtue of different key sequences. It is thus possible to use the different remote controls to implement various user guidance operations. Advantageously, these can then be defined on a user-specific or sector-specific basis.

The remote control and the receiver module may comprise a computation unit set up, by virtue of programming, to convert a signal train initiated by an input on the remote control into a signal train prescribed by the tachograph. The latter signal train then passes through the interface between the receiver module and the tachograph and prompts the tachograph to activate an appropriate display or output function. In contrast to the latter signal train, the signal train used to initiate a particular function—which signal train is initiated by the input on the remote control and does not need to have been stipulated by the tachograph—which is why different user guidance operations can be implemented for one and the same tachograph or for tachographs of the same type in the manner described.

The interface between the tachograph and the receiver module may be in the form of a K line while the remote control may be connected to the receiver module via a Bluetooth interface for the wireless data transmission. It is thus possible to use common interfaces and wireless transmission methods. The proposed system can be implemented with little complexity by resorting to known methods.

The remote control may be in the form of a mobile appliance or an appliance which can be installed in the vehicle. In the latter case, it is possible for the remote control to be installed at a freely selectable suitable position in the vehicle, so that the remote control can perform the function of a permanently installed operator control panel with the advantage that the precise arrangement does not yet need to have been stipulated when the tachograph is installed.

The tachograph may be part of a combination appliance which comprises at least one further appliance in addition to the tachograph. It is also possible for the remote control to be set up to control at least one further appliance in addition to the tachograph. By way of example, the at least one further appliance may be a navigation appliance or an infotainment system. It is therefore possible to use just one remote control, which may have been set up on a user-specific basis, to control a plurality of appliances, with it again not being necessary to have stipulated specifically which appliances these are when the tachograph or the combination appliance comprising the tachograph is installed.

The system according to one embodiment of the invention allows a remote control for vehicle information systems to be implemented independently of installation location and installation time. The system can be extended in modular fashion with keypads and displays. It is possible to implement a new operational management independently of the time of authorization and release, and different customer-specific or sector-specific user guidance can be implemented at any time without taking action in the qualified system defined by the digital tachograph and the vehicle architecture even after the vehicle has been delivered.

BRIEF DESCRIPTION OF THE DRAWINGS

An exemplary embodiment of the invention is explained below with reference to a drawing, in which:

FIG. 1 is a schematic illustration of a system for controlling a digital tachograph with a receiver module and a first and a second remote control.

DETAILED DESCRIPTION OF THE PREFERRED EMBODIMENTS

FIG. 1 shows a schematic illustration of a system for controlling a digital tachograph 1 with a receiver module 2 and a first remote control 3 and also with a second remote control 4. In this case, the tachograph 1 has been installed permanently in a vehicle, which is not shown, so that it cannot be separated therefrom without discernable traces.

The digital tachograph 1 has a control face which is equipped with a plurality of keys 5, two card slots 6, a printer 7 and a display 8. A detachable K line interface connects the digital tachograph 1 to the receiver module 2, which to this end can be positioned in an appropriate socket in the tachograph 1, preferably at a position that is not entirely feely accessible. For wireless data transmission, which is in the form of a Bluetooth interface the receiver module 2 is connected to the first remote control 3 and/or to the second remote control 4, with one of the remote controls 3 and 4 also being able to be installed at a position which is easily accessible to a driver in a vehicle.

The first remote control 3 and the second remote control 4 are each equipped with a keypad 9 and a display 10, and since the remote controls 3 and 4 also each comprise a reception part in addition to a transmitter, and the receiver module 2 additionally comprises a transmitter, the remote controls 3 and 4 are also set up for wireless reception of data from the digital tachograph 1.

Appropriate inputs using the remote controls 3 and 4 allow particularly working hours and distances traveled to be queried, and printouts with information that has been ascertained by the tachograph 1 can be retrieved. This information can be presented directly on the display 10 of the remote controls 3 and 4.

The activation of a particular function or setting of the tachograph 1 using the remote controls 3 and 4 is logically different than activation of the same function using the operator control elements on the tachograph 1 itself.

If a daily printout is requested this requires a comparatively complex key sequence to be operated on the tachograph itself, since only a few keys 5 are available on the tachograph 1 itself for a multiplicity of functions and settings for the tachograph 1. Since the remote controls 3 and 4 have a significantly greater number of keys, it is possible for a multiplicity of frequently used functions and settings for the tachograph 1 to be activated with just one keystroke on one of the remote controls 3 and 4.

For the purpose of documenting activities outside of the vehicle, taking along the remote controls 3 or 4 allows relevant data to be input or otherwise captured or transferred from another time recording system in situ, said data then being transmitted from the remote control to the tachograph.

In order to associate a particular function or setting of the tachograph 1 with a selected key on the remote controls 3 and 4, user guidance is used provided in a defined manner by the remote controls 3 and 4 or the configuration thereof. The display of the remote controls 3 and 4 displays to a user which keys have been assigned for associations which he has already made and which keys or key sequences are still available for further associations of functions and settings.

In order to implement user-specific or sector-specific operator control of the tachograph 1, it is possible to use a plurality of remote controls 3 and 4 which are of different design or on which respective different user-specific or sector-specific presets and user-related key function associations have been made. By way of example, it is thus possible for each of the remote controls 3 and 4 to be associated with precisely one of a plurality of users. To this end, it is naturally also possible for a greater number of remote controls to be provided.

Furthermore, the remote controls 3 and 4 may be designed for the user-specific or sector-specific operator control of the tachograph 1 such that a user uses a particular identification code which activates the presets and key function associations which he has made on a selected remote control 3 or 4. A second user can then use a different stipulated identification code for the same remote control 3 or 4 in order to activate presets and key function associations which he has made on the same remote control 3 or 4.

The remote controls 3 and 4 can thus use different key sequences and particularly different key sequences than the operator control elements of the tachograph 1 itself to activate particular functions and settings of the tachograph 1 and can also define different user guidance operations in this respect. The remote controls 3 and 4 and the receiver module are therefore each equipped with a processor which converts the signal trains initiated by the key sequences from the remote controls 3 or 4 into signal trains which have been stipulated by the tachograph for the functions that are to be initiated and which allow the tachograph to proceed as appropriate.

The tachograph 1 may also be part of a combination appliance which comprises one or more further appliances, such as an infotainment system or a navigation appliance, in addition to the tachograph 1, these appliances also being able to be actuated by means of the receiver module 2 using the remote controls 3 and 4. If it is possible to dispense with simple interchangeability, it is naturally also possible to omit one of the remote controls 3 or 4 from the system described.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A system for capturing operating data for a vehicle, comprising:

a digital tachograph configured to be installed permanently in the vehicle;

a receiver module detachably connected to the tachograph via an interface that is prescribed by the tachograph and configured to receive data to control the tachograph;

at least one remote control having a transmitter configured for wireless data transmission with the receiver module and configured to control the tachograph; and at least one first remote control and a second remote control each configured to transmit data to the receiver module, the first and second remote controls differ from one another such that an input on the first remote control which is prescribed for the purpose of activating a particular function or setting for the tachograph differs from an input for the purpose of activating the same function or setting by the second remote control.

2. The system as claimed in claim 1, wherein the at least one remote control is configured to query at least one of working hours, distances traveled, and to request printouts with information ascertained by the tachograph.

3. The system as claimed in claim 1, wherein the at least one remote control further comprises:

a receiver configured to receive information ascertained by the tachograph and transmitted by a transmitter of the receiver module; and a display for displaying the information.

4. The system as claimed in claim 1, wherein an input of the at least one remote control for activating one or more of a particular function and setting for the tachograph is logically different than an input for the purpose of activating the same function or setting on the tachograph itself.

5. The system as claimed in one of claim 1, wherein said inputs are different from one another by virtue of different key sequences.

6. The system as claimed in claim 1, wherein at least one of the remote control and the receiver module comprises a computation unit configured by programming to convert a signal train initiated by an input on the remote control into a signal train prescribed by the tachograph.

7. The system as claimed in claim 1, wherein the interface between the tachograph and the receiver module is a K line.

8. The system as claimed in claim 1, wherein the at least one remote control is connected to the receiver module via a Bluetooth interface for the wireless data transmission.

9. The system as claimed in claim 1, wherein the remote control is one or more of a mobile appliance and an appliance installed in the vehicle.

10. The system as claimed in claim 1, wherein the tachograph is part of a combination appliance that comprises at least one further appliance.

11. The system as claimed in claim 1, wherein the at least one remote control is configured to control at least one further appliance in addition to the tachograph.

12. The system as claimed in claim 10, wherein the at least one further appliance is one of a navigation appliance and an infotainment system.

13. A vehicle, containing a system, comprising:

a digital tachograph permanently installed in the vehicle;

a receiver module detachably connected to the tachograph via an interface prescribed by the tachograph and configured to receive data to control the tachograph; and at least one first remote control and a second remote control each having a transmitter configured for wireless data transmission with the receiver module and configured to control the tachograph, the first and second remote controls differ from one another such that an input on the first remote control which is prescribed for the purpose of activating a particular function or setting for the tachograph differs from an input for the purpose of activating the same function or setting by the second remote control.

14. The system as claimed in claim 11, wherein the at least one further appliance is one of a navigation appliance and an infotainment system.

* * * * *